US005080254A

United States Patent [19]

Feer

[11] Patent Number: 5,080,254

[45] Date of Patent: Jan. 14, 1992

[54] ADHESIVE NOTE PAD PAPER DISPENSER

[75] Inventor: David L. Feer, Medina, Ohio

[73] Assignee: Rubbermaid Incorporated, Wooster, Ohio

[21] Appl. No.: 477,607

[22] Filed: Feb. 9, 1990

[51] Int. Cl.[5] ..... B65H 1/00

[52] U.S. Cl. ..... 221/33; 221/45; 221/56; 221/197; 206/39; 206/215

[58] Field of Search ..... 221/26, 33, 45, 46, 221/50, 51, 52, 56, 57, 58, 59, 61, 197, 198, 287; 206/39, 39.3, 39.7, 39.8, 215, 494, 559, 560; 211/50

[56] References Cited

U.S. PATENT DOCUMENTS

| | | | |
|---|---|---|---|
| 2,769,569 | 11/1956 | Sinclair | 221/58 X |
| 2,849,153 | 8/1958 | Tuttle | 221/45 X |
| 4,199,076 | 4/1980 | Brown | 221/59 X |
| 4,231,837 | 11/1980 | Ramey et al. . | |
| 4,327,875 | 5/1982 | Lightfoot . | |
| 4,416,392 | 11/1983 | Smith | 221/45 |
| 4,562,938 | 1/1986 | Loder | 221/46 |
| 4,586,629 | 5/1986 | Loder | 221/46 |
| 4,586,631 | 5/1986 | Loder | 221/58 |
| 4,653,666 | 3/1987 | Mertens | 221/45 |
| 4,667,828 | 5/1987 | Samuelson . | |
| 4,696,399 | 9/1987 | Windorski . | |
| 4,770,320 | 9/1988 | Miles et al. | 221/33 |
| 4,781,306 | 11/1988 | Smith | 221/33 |
| 4,796,781 | 1/1989 | Windorski | 221/45 |
| 4,921,127 | 5/1990 | Windarski | 221/52 X |
| 4,953,747 | 9/1990 | Wenkman et al. | 221/45 |

*Primary Examiner*—Joseph E. Valenza
*Assistant Examiner*—Tuan N. Nguyen
*Attorney, Agent, or Firm*—Renner, Kenner, Greive, Bobak, Taylor & Weber

[57] ABSTRACT

A dispenser (10) for a paper pad (P) of note paper of the type having sheets (S) releasably adhered to each other along opposite edges of successive sheets (S) by a narrow band of adhesive includes a base container member (11) and an insert member (12). The base container member (11) receives the pad (P) therein and carries a leaf spring (26) having leaves (27) which apply an upward force to the pad (P) generally adjacent to the edges of the sheets (S) which have the narrow band of adhesive. The insert member (12) is positioned above the pad (P), is received within the base container member (11), and has a top surface (37) with a slot (38) therein through which the sheets (S) may be dispensed. Lock barbs (44, 52) formed on the insert member (12) engage apertures (35, 36) in the base container member (11) to temporarily attach the insert member (12) to the base container member (11).

21 Claims, 3 Drawing Sheets

ADHESIVE NOTE PAD PAPER DISPENSER

TECHNICAL FIELD

This invention relates to a device for holding and dispensing note paper. More particularly, this invention relates to a dispenser for note pad paper of the type in which the sheets of paper are held together by a narrow band of adhesive positioned on one edge of a side of the sheets.

BACKGROUND ART

In recent years note pads in which the sheets are provided with a repositionable pressure sensitive adhesive along one edge of the sheets have become quite popular. Typical of such note pads are those sold under the POST-IT trademark by Minnesota Mining and Manufacturing Company, St. Paul, Minn. In some such note pads the individual sheets are affixed to each other in an accordion style, that is, each sheet is adhered to the next adjacent sheet with the adhesive being positioned on alternately opposite edges of successive sheets so that the pad can be utilized with a dispenser. Such dispensers thus provide an organized manner in which to store the note pads on one's desk and yet enable the user to dispense one sheet at a time as desired.

Typical of these note pad dispensers is that shown in U.S. Pat. No. 4,416,392. In that patent, which is primarily directed to a disposable dispenser, a coil spring located centrally underneath the pad biases the sheets toward the top dispensing opening so that the dispensing force exceeds the peeling force for consistent dispensing of the sheets. In a disposable dispenser made out of card stock paper, the biasing forces had to be at the center of the stack, rather than at the adhesive edges where it would be preferred, because if the forces were at the edges, the dispenser would tend to tear along its edges.

With the spring force generally at the center, however, the note paper tends to curl and as a solution to that problem a dispenser according to U.S. Pat. No. 4,653,666 was developed whereby flaps of a polymeric material were attached to the card stock and extended across the opening in the top of the dispenser. These flaps created a reverse bend force to the note paper thereby tending to straighten the disadvantageous curl.

However, disposable dispensers such as just described, are not the economic solution to dispensing sheets from such note pads because the cost of the spring, flaps and the like significantly add to the cost of the note paper making it impractical for one to purchase the note paper in such a dispenser.

In response to this problem, a refillable dispenser for conventional sized note pads was developed as shown in U.S. Pat. No. 4,796,781. This dispenser included an economically manufactured plastic base portion into which the note pad was placed. The coil spring was eliminated by providing a heavy insert member made, for example, from cast iron, which nested within the base and through its weight exerted enough force on the note pad paper to exceed the force of drawing a sheet through the top opening of the dispenser and peeling the sheet from the next adjacent sheet in the pad. While solving at least some of the problems attendant to the disposable dispensers, this refillable dispenser cannot be economically manufactured in view of the cost of the required heavy insert member and, in addition, such a heavy member makes the costs of shipping large quantities of dispensers uneconomical.

As such, a need still exists for a light weight, economically manufactured, refillable note pad paper dispenser which will consistently and uniformly dispense such paper without curling or otherwise deforming the same. The device of the present invention satisfies that need.

DISCLOSURE OF THE INVENTION

It is thus a primary object of the present invention to provide a dispensing container for note paper pads of the type having sheets of paper with a narrow band of adhesive on one surface along one edge to adhere one sheet to the next adjacent sheet which has the narrow band of adhesive at the opposite edge thereof.

It is another object of the present invention to provide a dispensing container, as above, which can be refilled with a fresh note pad upon the depletion of the note pad currently being dispensed and thus can be a permanent desk accessory.

It is an additional object of the present invention to provide a dispensing container, as above, which efficiently dispenses sheets from the note pad without distortion or mutilation thereof.

It is a further object of the present invention to provide a dispensing container, as above, which applies the force within the container necessary to exceed the force of withdrawing a sheet from the dispenser at the edges of the sheets adjacent to the adhesive thereby providing efficient removal of the sheets without damage to the dispenser or the sheets.

It is yet another object of the present invention to provide a dispensing container, as above, which can be economically manufactured.

These and other objects of the present invention, as well as the advantages thereof over existing prior art forms, which will become apparent from the description to follow, are accomplished by the means hereinafter described and claimed.

In general, a dispensing container is designed to hold and dispense sheets from a note pad of the type where the sheets are releasably attached to each other along opposite edges of successive sheets by a narrow band of adhesive. The dispensing container includes a base portion which is adapted to hold the note pad. The base carries a leaf spring which applies an upward force to the note pad at a location generally underneath the edges of the sheets having the narrow band of adhesive. A hold-down member is positioned within the base and above the note pad. The hold-down member has a top surface with an aperture therein through which the sheets are dispensed. The hold-down member can be temporarily attached to the base by applying downward pressure thereto against the upward pressure of the leaf spring.

A preferred exemplary note pad sheet dispensing container incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
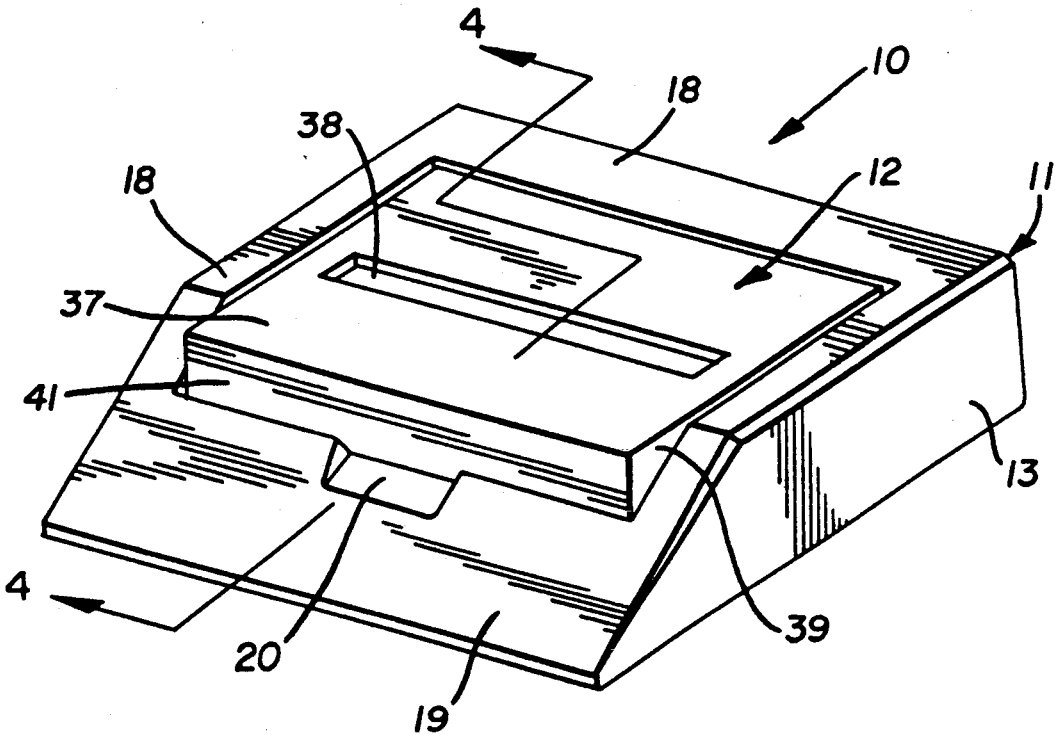
FIG. 1 is a perspective view of an adhesive note pad paper dispenser according to the concept of the present invention.

A note pad paper holder and dispenser according to the concept of the present invention is indicated generally by the numeral 10 in the drawings and is shown in its assembled form in FIG. 1. Dispenser 10 includes a base container member, indicated generally by the numeral 11, and a paper hold-down insert member generally indicated by the numeral 12.

Figure 4:
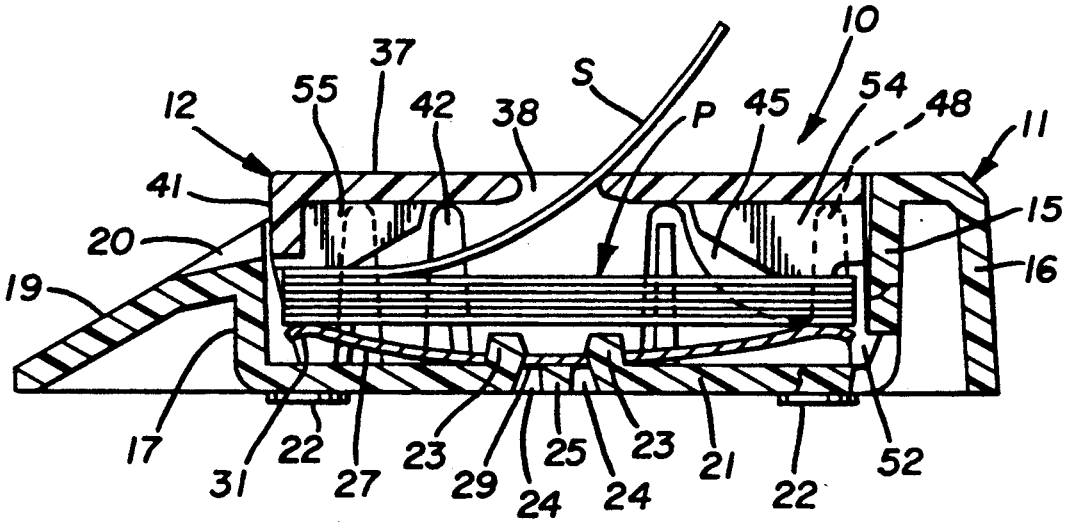
FIG. 4 is a sectional view taken substantially along line 4—4 of FIG. 1.
Figure 5:
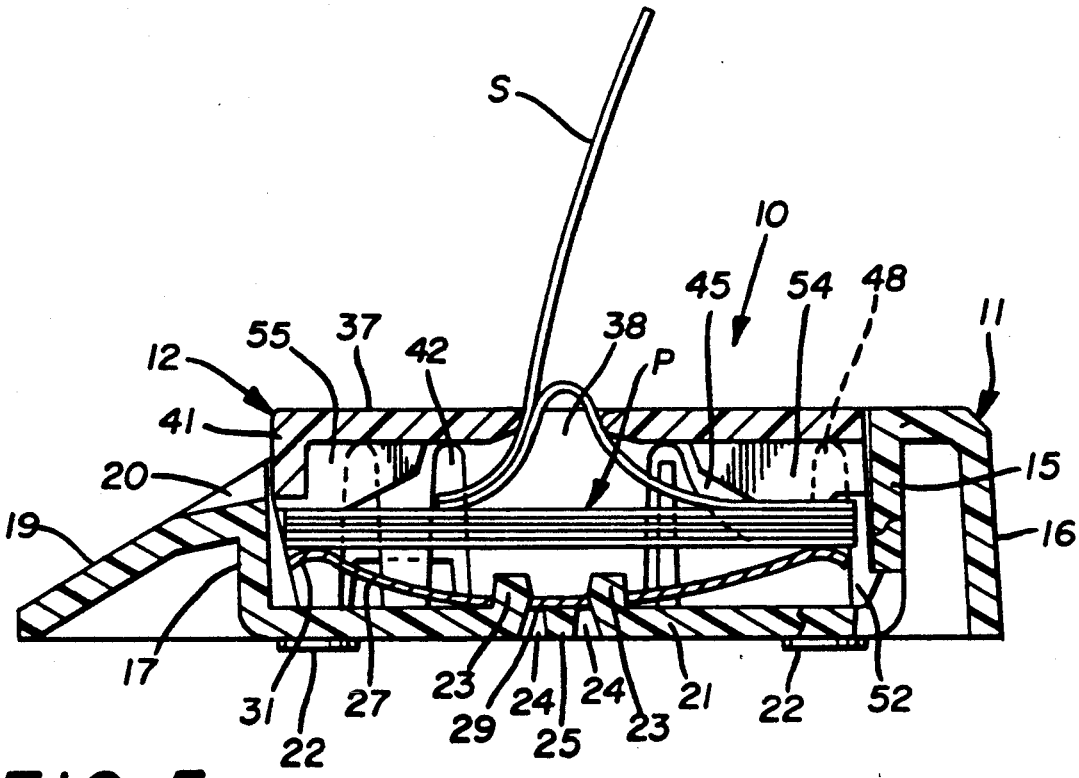
FIG. 5 is a view similar to FIG. 4 showing the note pad paper being dispensed.
Figure 6:
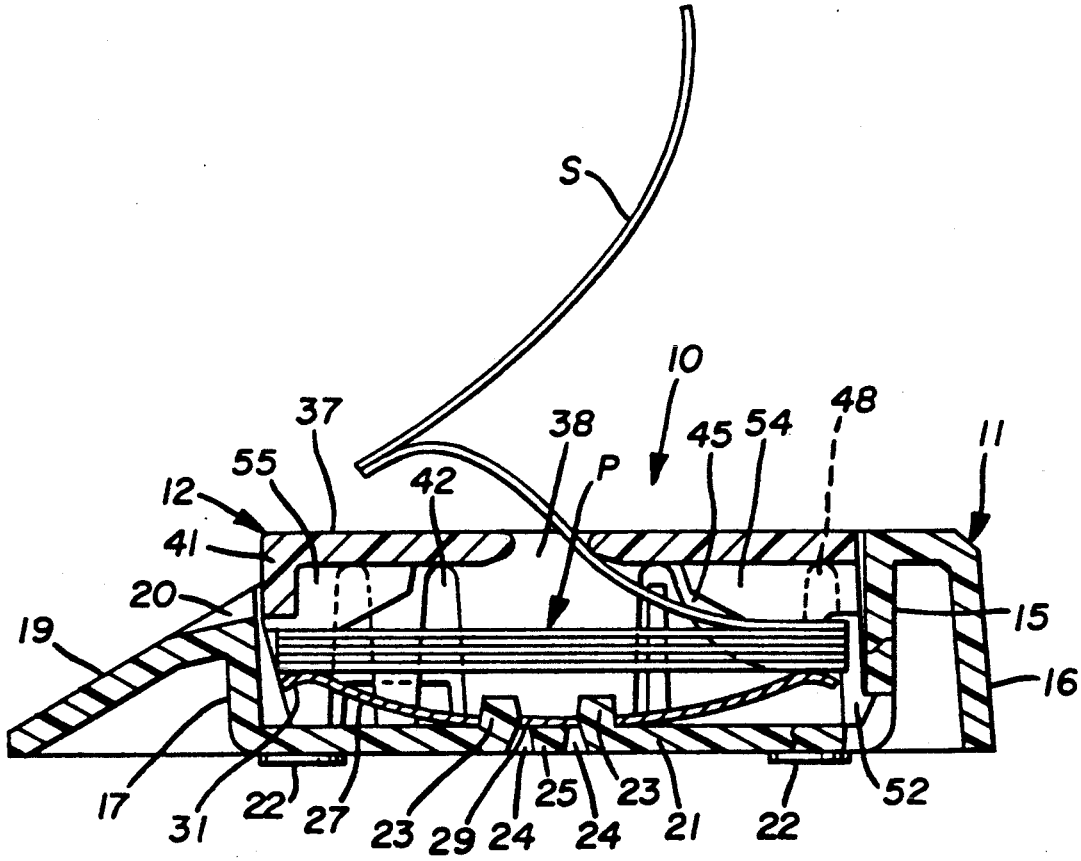
FIG. 6 is a view similar to FIG. 4 showing the dispensing of the note pad paper at a point in time sequentially following FIG. 5.

Base member 11 includes generally vertical sidewalls 13 and 14 and, as shown in FIG. 4, inner and outer generally vertical rear walls 15 and 16, respectively, as well as a generally vertical front wall 17 of a lesser height than walls 13, 14, 15 and 16. Together, walls 13, 14, 15 and 17 define base member 11 as an open top container for receiving a pad P of note paper. As shown, dispenser 10 is particularly suited to receive a pad P of the type having a narrow band of adhesive on one end of each sheet S thereof with adjacent successive sheets S having the adhesive on alternating opposite edges so that the sheets S are adhered in an accordion style to form pad P. Thus, for example, as shown in FIGS. 4–6, the top sheet S of pad P is adhered to the second sheet S of pad P at the left edge with the second sheet S being adhered to the third sheet S on the right edge and so forth throughout pad P. Such pads are conventional items sold, for example, under the trademark POST-IT by Minnesota Mining and Manufacturing Company of St. Paul, Minn.

Base member 11 also includes a generally horizontal planar top surface 18 around the sides and rear periphery thereof which terminates just short of front wall 17. A beveled front face surface 19 extends upwardly and terminates centrally at front wall 17 and peripherally at top surface 18. Surface 19 is interrupted at the top and centrally thereof to provide a notch 20, the purpose of which will be hereinafter described.

The bottom surface 21 of base member 11 may be provided with a plurality of feet 22 (FIG. 4) and includes spring mounting lugs 23 projecting upwardly therefrom near the center thereof. Each lug 23 is positioned adjacent to a slot 24 in bottom surface 21 thereby establishing a support bar 25 between slots 24.

Lugs 23 carry a leaf spring, indicated generally by the numeral 26, having biasing leaves 27, each of which have a generally rectangular or square aperture 28 (one shown) cut therein near the bottom thereof. Each edge of a mounting strip 29 formed between apertures 28 can be conveniently positioned within slots 24 of bottom surface 21 and snapped underneath the overhang of lugs 23 to position spring 26 in base member 11. Mounting strip 29 thus spans slots 24 and the support bar 25 therebetween.

Leaves 27 of spring 26 are also provided with a plurality of slots 30 running in the longitudinal direction along the majority of the length of leaves 27, that is, in the direction from front wall 17 to rear wall 15 of base member 11. As shown, there are preferably four slots 30 with two such slots being symmetrically positioned on each side of apertures 28. It has been found that by providing spring 26 with such slots so positioned, spring 26 may be most efficiently manufactured to most effectively provide the desired forces at the upper edges thereof. As will hereinafter be explained in more detail, it is necessary that the force of spring 26 on pad P be less than the force required to remove a sheet S from dispensers 10 but be more than the force required to peel one sheet S from the next adjacent sheet S.

In order to evenly distribute these forces over the area of the adhesive edges of sheets S, the upper end of each leaf 27 may be rolled over, as at 31, to provide a support surface for pad P. Moreover, the outer corners of the upper end of each leaf 27 may be provided with a burr 32 to assist in the frictional engagement with pad P that may be necessary as the sheets S become depleted therefrom.

Sidewalls 13 and 14 of base member 11 are each provided with a generally vertical rib 33 extending upwardly from bottom surface 21, only the rib 33 on wall 13 being shown in the drawings. Similarly, rear wall 15 is provided with a rib 34 generally centrally thereof. Ribs 33 and 34 not only serve to locate pad P within base member 11, but also they assist in the proper installation and removal of insert member 12 as will be hereinafter described. In addition, sidewalls 13 and 14 each include a small aperture or detent 35 therein near the bottom thereof near front wall 17, only the aperture 35 in wall 14 being shown in the drawings. Similarly, inner rear wall 15 is provided with apertures or detents 36 therein near the bottom thereof and near sidewalls 13 and 14, only the aperture 36 near wall 14 being shown in the drawings. As will hereinafter be described, apertures 35 and 36 assist in the attachment of insert member 12 to base member 11.

Figure 2:
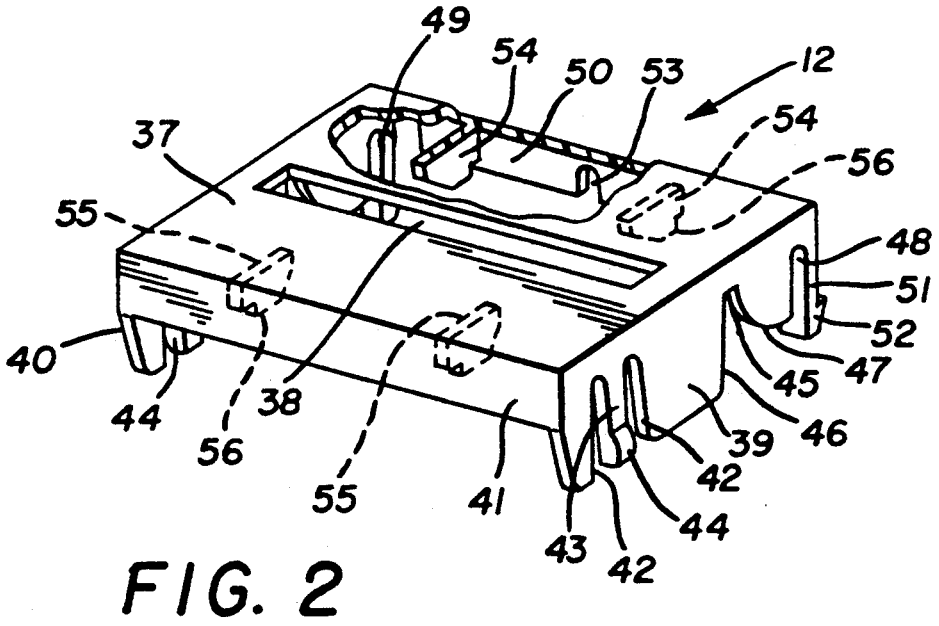
FIG. 2 is a partially broken away perspective view of the insert hold-down member removed from the base container member both of which together form the adhesive note pad paper dispenser.

As best shown in FIG. 2, insert member 12 includes a generally horizontal planar top surface 37 having a slot 38 therein extending generally laterally from near one sidewall 39 of insert member 12 to near the other sidewall 40 in a direction generally perpendicular to slots 30 in spring 26. Insert member 12 also includes a front face 41 which extends generally vertically downward from top surface 37 to an extent of approximately one-half the height of sidewalls 39 and 40.

Sidewalls 39 and 40 of insert member 12 are essentially identical, being mirror images of each other. Each sidewall 39, 40 includes two generally vertically oriented slots 42 provided near the front end thereof. Slots 42 extend from the bottom of each sidewall and terminate short of top surface 37 to thereby define a somewhat resilient clip member 43 having a locking barb 44 at the bottom thereof and extending outwardly beyond sidewalls 39 and 40. Sidewalls 39 and 40 are also provided with a notch 45 defined on one side by a generally vertical wall 46 and on the other side by the upper portion of an arcuate surface 47 formed in sidewalls 39 and 40. Arcuate surfaces 47 extend downwardly from notches 45 to a lowermost point less than the height of sidewalls 39 and 40 at which point a generally vertically oriented slot 48 is formed in sidewalls 39 and 40. Slots 48 define, with similar slots 49 (one shown in FIG. 2) formed in the rear wall 50 of insert member 12 near the lateral ends thereof, a somewhat resilient clip member 51 generally located at each rear corner of insert member 12. Like clip members 43, clip members 51 each have a locking barb 52 at the bottom thereof which extends outwardly beyond the rear wall.

As shown in FIG. 2, rear wall 50 of insert member 12 is also provided with a generally centrally located slot 53 therein which, as will hereinafter be described, cooperates with rib 34 of base member 11 when dispenser 10 is assembled. In addition, as shown in FIG. 2, two pad hold-down ribs 54 extend inwardly from rear wall 50 and downwardly from top surface 37 and similar aligned holddown ribs 55 extend inwardly from front face 41 and downwardly from top surface 37. Ribs 54 and 55 are shown as almost triangular in form (FIG. 4) but each have a lower flattened surface 56 which engage pad P at the location of the adhesived edges of sheets S when dispenser 10 is assembled.

Having now described base member 11 and insert member 12 in detail, the manner in which they cooperate to form dispensing container 10 will now be described. Before insert member 12 is positioned within base member 11, a pad P is placed on spring 26 with the adhesive edges on the sheets S thereof positioned on the rolled-over edges 31 of leaves 27. Ribs 33 and rib 34 will assist in the proper positioning of pad P.

Because the outer dimensions of insert member 12, except for barbs 44 and 52, are slightly less than the inner dimensions of the opening in base member 11, insert member 12 can readily be positioned and nested therein. Upon inserting member 12, ribs 33 of base member 11 will be positioned in notches 45 of insert member 12 thereby positively locating insert member 12, that is, assuring that it is oriented in the proper direction. Also, rib 34 of base member 11 will be received in slot 53 in rear wall 50 of insert member 12 for additional alignment and orientation assurance.

As insert member 12 is being positioned within base member 11, downward pressure on pad P is exerted by surfaces 56 of ribs 54 and 55 against the upward bias of spring 26 until insert member 12 is lowered far enough for locking barbs 44 to snap into and otherwise engage apertures or detents 35 in base member 11 and for locking barbs 52 to engage apertures or detents 36. Such is possible because, although both base member 11 and insert member 12 are preferably made of a light weight substantially rigid high impact polystyrene, barbs 44 and 52 are located on the end of clip members 43 and 51, respectively, which are rather flexible because they are relatively thin strips of high impact polystyrene. Thus, as insert member 12 is lowered to its fullest extent into base member 11, it is maintained therein even against the bias of spring 26 because barbs 44 have flexed inwardly against sidewalls 13 and 14 until snapping into apertures or detents 35 and similarly, barbs 52 have flexed inwardly against inner rear wall 15 until snapping into apertures or detents 36. In its fully installed position, top surface 37 of insert member 12 is flush with top surface 18 of base member 11 thereby forming a planar top surface for dispenser 10.

Figure 3:
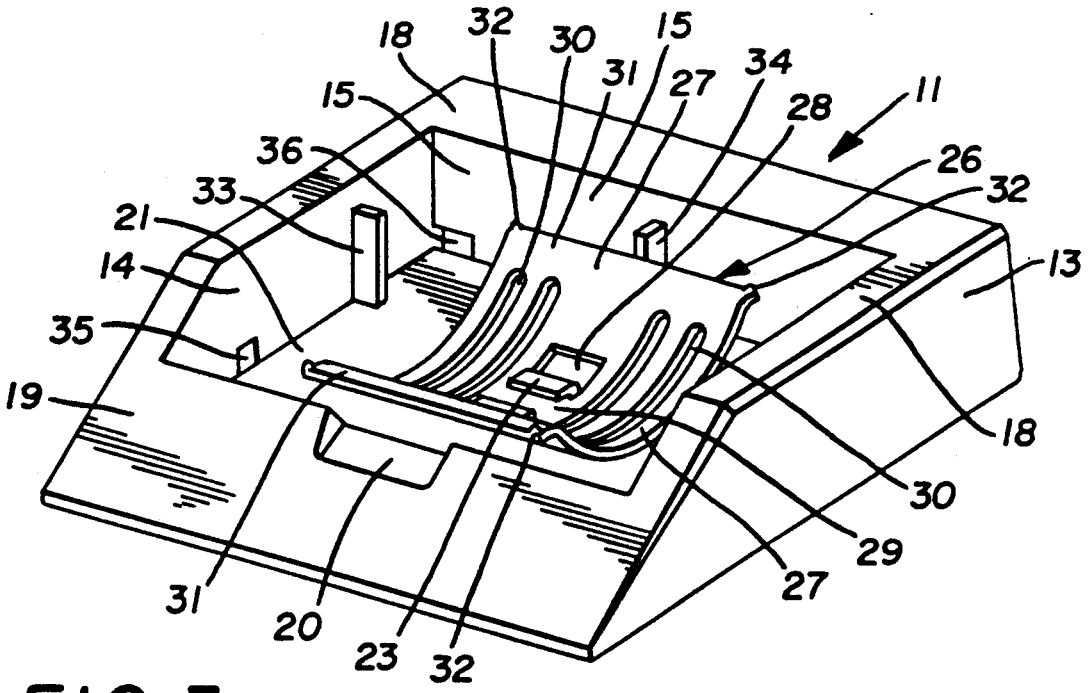
FIG. 3 is a perspective view of the base container member with the insert hold-down member removed therefrom.

Sheets S may now be dispensed from pad P as shown in FIGS. 4–6. The top sheet S is threaded through slot 38 and ready to be dispensed as shown in FIG. 4. At this point in time spring 26 is providing a uniform upward bias on the edges of sheets S having the adhesive thereon. Pulling on top sheet S to dispense the same, as shown in FIGS. 5 and 6, causes the second sheet S to be threaded through slot 38 before the first sheet S is separated from the second sheet S at which time separation may be effected and the second sheet S will be ready for dispensing. Such is accomplished because the opposite forces between spring 26 and insert member 12 do not exceed the force required to draw a sheet S through the dispensing slot 38 and yet do exceed the forces required to peel the sheets from the next adjacent sheet S in pad P. With a spring 26 configured as shown in FIG. 3, in particular having apertures 28 and slots 30 therein, and being made of carbon spring steel 0.004 inches thick, the forces generated by spring 26 are normally in the range of approximately 0.19 to 0.30 pounds. The force necessary to extract a sheet S is on the order of approximately 0.375 pounds and the force necessary to peel one sheet S from another is approximately 0.10 pounds. Thus, spring 26 will consistently apply forces to pad P adjacent to the point of the adhesived edge such that sheets S may be drawn therethrough and then separated without inadvertently drawing a second sheet through slot 38. As the pad P becomes close to depletion, burrs 32 on leaves 27 of spring 26 assure that enough frictional force is present to properly dispense even the last sheet.

When pad P is depleted, a fresh pad can be readily positioned in dispenser 10. This is most readily accomplished by the user applying slight upward pressure with his thumbs to front face 41 of insert member 12 at the location of notch 20 in base member 11, or at any convenient location along front face 41. Such action causes barbs 44 to be released from aperture or detents 35 and insert member 12 can thereby be rotated on an axis defined by barbs 52. During such rotation, ribs 33 of base member 11 ride along arcuate surface 47 of insert member 12 until barbs 52 are disengaged from apertures or detents 36. At such time, insert member 12 is released from base member 11 and a fresh pad P may be placed in base member 11.

It should now be apparent that a note pad container and dispenser constructed as described herein substantially improves the art and otherwise accomplishes the objects of the invention.

I claim:

1. Apparatus for containing a note pad and permitting the dispensing of sheets of paper therefrom, the sheets forming the pad by being releasably adhered to each other along opposite edges of successive sheets by a narrow band of adhesive, comprising base container means for receiving the note pad, a leaf spring carried by said base container means and having leaves which engage and apply an upward force to the note pad only under the edges of the sheets having the narrow band of adhesive, insert means positionable above the note pad and received within said base container means, said insert means having a top surface with a slot therein through which the sheets may be dispensed, and means to temporarily attach said insert means to said base container means upon applying a downward force against said leaf spring.

2. Apparatus according to claim 1 wherein said temporarily attach said insert means to said container means includes aperture means in said container means and resilient clip means on insert means.

3. Apparatus according to claim 2 further comprising means carried by said resilient clip means, means being engageable with said aperture means.

4. Apparatus according to claim 1 wherein said container means includes rib means to properly the pad therein.

5. Apparatus according to claim 1 further comprising slot apertures in said leaves extending in a direction generally perpendicular to said slot in said insert means.

6. Apparatus according to claim 1 wherein said insert means includes hold-down rib means extending downwardly from said top surface to engage the pad and act against the force of said leaves of said leaf spring.

7. Apparatus according to claim 6 wherein the force of said leaves does not exceed the force required to draw a sheet through said slot in said insert means but does exceed the force required to peel one sheet from an adjacent sheet in the pad.

8. Apparatus according to claim 7 wherein the upper edges of said leaves are rolled over to provide a surface to engage the edges of the sheets having the narrow band of adhesive.

9. Apparatus according to claim 1 further comprising burr means on the upper corners of said leaves to assist in the frictional engagement of the pad.

10. Apparatus according to claim 1 wherein said base container means includes a bottom surface and further comprising lug means on said bottom surface to engage said leaf spring.

11. Apparatus according to claim 10 wherein said leaf spring includes a mounting strip between said leaves to be engaged by said lug means.

12. Apparatus according to claim 1 wherein said base container means includes a front wall, rear wall and sidewalls defining an open top container and said insert means includes a front wall, rear wall and sidewalls nestable within the open top of said base container means.

13. Apparatus according to claim 12 wherein said means to temporarily attach said insert means to said base container means includes first means in said sidewalls and rear wall of said base container means and second means in said sidewalls and rear wall of said insert means, said first and second means cooperating to temporarily attach said insert means to said base container means.

14. Apparatus according to claim 13 wherein said first means includes detent means in said sidewalls and rear wall of said base container means, and said second means includes barb means receivable in said detent means.

15. Apparatus according to claim 14 wherein said second means further includes resilient clip means carrying said barb means.

16. Apparatus according to claim 15 further comprising slots in said sidewalls of said insert means positioned adjacent to and thereby defining said resilient clip means.

17. Apparatus according to claim 1 wherein said insert means includes a front face to be engaged to remove said insert means from said base container means.

18. Apparatus for containing a note pad and permitting the dispensing of sheets of paper therefrom, the sheets forming the pad by being releasably adhered to each other along opposite edges of successive sheets by a narrow band of adhesive, comprising base container means including a front wall, rear wall and sidewalls defining an open top container for receiving the note pad, biasing means carried by said base container means and applying an upward force to the note pad generally adjacent to the edges of the sheets having the narrow band of adhesive, insert means positionable above the note pad and including a front wall, rear wall and sidewalls nestable within the open top of said base container means, said insert means having a top surface with a slot therein through which the sheets may be dispensed, means to temporarily attach said insert means to said base container means upon applying a downward force against said biasing means, rib means on said sidewalls of said base container means, and notch means in said sidewalls of said insert means, said rib means engaging said notch means to locate said insert means in said base container means.

19. Apparatus according to claim 18 further comprising an arcuate surface in said sidewalls of said insert means, said arcuate surface being located adjacent to said notch means and cooperating with said rib means during the removal of said insert means from said base container means.

20. Apparatus for containing a note pad and permitting the dispensing of sheets of paper therefrom, the sheets forming the pad by being releasably adhered to each other along opposite edges of successive sheets by a narrow band of adhesive, comprising base container means for receiving the note pad, said base container means including a rear wall, sidewalls and a planar top surface around the periphery of said rear wall and said sidewalls, biasing means carried by said base container means and applying an upward force to the note pad generally adjacent to the edges of the sheets having the narrow band of adhesive, insert means positionable above the note pad and received within said base container means, said insert means having a top surface with a slot therein through which the sheets may be dispensed, and means to temporarily attach said insert means to said base container means upon applying a downward force against said biasing means, said planar top surface of said base container means being flush with said top surface of said insert means when said insert means is attached to said base container means.

21. Apparatus for containing a note pad and permitting the dispensing of sheets of paper therefrom, the sheets forming the pad by being releasably adhered to each other along opposite edges of successive sheets by a narrow band of adhesive, comprising base container means for receiving the note pad, biasing means carried by said base container means and applying an upward force to the note pad generally adjacent to the edges of the sheets having the narrow band of adhesive, insert means positionable above the note pad and received within said base container means, said insert means having a top surface with a slot therein through which the sheets may be dispensed, means to temporarily attach said insert means to said base container means upon applying a downward force against said biasing means, said insert means having a front face to be engaged to remove said insert means from said base container means, and notch means in said base container means and adjacent to said front face to provide additional access to said front face.

* * * * *

UNITED STATES PATENT AND TRADEMARK OFFICE

CERTIFICATE OF CORRECTION

PATENT NO. : 5,080,254

DATED : January 14, 1992

INVENTOR(S) : David L. Feer

It is certified that error appears in the above-identified patent and that said Letters Patent is hereby corrected as shown below:

Column 5, line 13, "holddown" should read --hold-down--.

Column 6, line 59 (Claim 2, line 1), after "said" insert --means to--; line 60 (line 2), after "said" (second occurrence) insert --base--; line 61 (line 3), after "said" insert --base--; line 62 (line 4), after "on" insert --said--.

Column 6, line 63 (Claim 3, line 1), after "comprising" insert --barb--; line 64 (line 2), after "means," insert --said barb--.

Column 6, line 66 (Claim 4, line 1), after "said" insert --base--; line 67 (line 2), after "properly" insert --locate--.

Signed and Sealed this

Nineteenth Day of October, 1993

*Attest:*

Bruce Lehman

BRUCE LEHMAN

*Attesting Officer*

*Commissioner of Patents and Trademarks*